US008460133B2

(12) United States Patent
Williams

(10) Patent No.: US 8,460,133 B2
(45) Date of Patent: Jun. 11, 2013

(54) SLAM STRAP

(76) Inventor: Lawrence Christopher Williams, Hampstead, NC (US)

( * ) Notice: Subject to any disclaimer, the term of this patent is extended or adjusted under 35 U.S.C. 154(b) by 282 days.

(21) Appl. No.: 13/068,721

(22) Filed: May 18, 2011

(65) Prior Publication Data

US 2012/0295743 A1 Nov. 22, 2012

(51) Int. Cl.
*A63B 61/04* (2006.01)

(52) U.S. Cl.
USPC ..... 473/495

(58) Field of Classification Search
USPC ..... 473/490, 491, 494, 495; 273/DIG. 30; 24/306, 90.1, 379.1, 300–302, 442
See application file for complete search history.

(56) References Cited

U.S. PATENT DOCUMENTS 1,239,924 A * 9/1917 Lord ..... 52/155
1,351,066 A * 8/1920 Robinson ..... 473/495
1,409,981 A * 3/1922 Vaile ..... 473/495
1,534,447 A * 4/1925 Hardy ..... 473/495
3,549,146 A * 12/1970 Davis ..... 473/474
4,247,099 A * 1/1981 Pandak ..... 473/474
4,671,509 A * 6/1987 Newman ..... 473/495
4,973,055 A * 11/1990 Muir ..... 473/495
6,868,619 B1 * 3/2005 Boren et al. ..... 33/760
6,955,617 B1 * 10/2005 Boren et al. ..... 473/495
2003/0014878 A1 * 1/2003 Smith ..... 33/759

* cited by examiner

*Primary Examiner* — Raleigh W Chiu

(57) ABSTRACT

A tennis net center strap created for the professional level that quickly measures and secures the center of any tennis net to the regulation (currently 36 inches) height above the court surface. The strap is made of non-stretch material woven with specific material to insure strength and durability. There is a discrete measuring system built into the strap that sets any net, on any court to the correct regulation height in seconds without the use of external measuring devices. It incorporates a simple internal multi-fastening system that meets the needs of the professional tour level, while locking in the correct height, and guaranteeing no deviation or slippage. One end of the strap has a non-rust alloy, nickel plated tab (with an extra protective coating) to insure a finite measuring point that will not fray or deteriorate in weather. The strap is held onto the net via a non-rust nickel plated swivel snap clip with a two inch loop eye on one end. The snap clip fastens to any court surface anchor system (above or below ground), while allowing the strap to navigate easily through the loop eye opening. Once installed, this tennis net strap is visually clean, guards against false "let" calls monitored by electronic or other devices, and meets the needs of the professional tennis tour.

1 Claim, 4 Drawing Sheets

SLAM STRAP

CROSS REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

This current invention is considered sporting equipment, and generally pertains to permanent and non-permanent straps that adjust and maintain a regulation height of any Tennis Net.

Current U.S. Class:
473/495; 24/625

International Class:
A63B 061/00

Field of Search: 273/29 BA 24/627, 628, 629, 630, 631, 632, 634, 635, 635

REFERENCES CITED

| U.S. Pat. Documents: | | | |
|---|---|---|---|
| 1,239,924 | September 1917 | Lord | 273/29. |
| 1,351,066 | August 1920 | Robinson | 273/29. |
| 140,997 | March 1920 | Vaile | 273/29. |
| 1,534,447 | April 1925 | Hardy | 273/29. |
| 3,549,146 | December 1970 | Davis | 273/29. |
| 4,247,099 | January 1981 | Pandak | 273/29. |
| 4,671,509 | June 1987 | Newmann | 273/29. |
| 4,831,694 | May 1989 | Kong | 24/635. |
| 4,973,055 | November 1990 | Muir | 273/29. |
| 6,868,619 | March 2005 | Boren, et al | 273/29. |
| 6,955,617 | October 2005 | Boren, et al | 273/29. |
| Foreign Patent Documents: | | | |
| 190006 | December 1922 | GB | 273/29. |
| 344615 | March 1931 | GB | 273/29. |
| 516402 | January 1940 | GB | 273/29. |
| 2138879 | October 1984 | GB | 24/634 |

The tennis net is supported by a metal cable that is attached to two posts, and divides a tennis court by two equal parts. The posts are tall enough to hold and maintain the net to the current regulation height of 42 inches at each post, allowing the net to be drawn down to a current regulation height of 36 inches at the center of the court. In order to prepare for regulation play, the net must be a current regulation height of 36 inches in the center of the net. All tennis courts incorporate some form of anchor at the court surface, some above ground and some below ground that will have a net strap of varying design that hooks into the anchor by varying styles of a clasp or clip device. These described net straps and clips attempt to hold the net down to facilitate regulation play. Maintaining the net at the regulation height is imperative to the game of tennis. The slightest deviation from this 36 inch height can have a negative impact on scoring, and thus impact a match. Professional tournaments have umpires who check the height of the net after each set to insure that it remains at a perfect 36 inches. The majority of the time the net becomes too high due to the impact of the ball hitting it repetitively. And, the pressure of the net being pulled downward from its initial taut position is generally too much for the average net strap to maintain. Without the proper fastening system, the net inevitably inches back to its original position. Due to these issues, the nets have to be measured and adjusted regularly to insure the correct height. Also, at the professional level, the nets are constantly being taken down to clean the courts off after a day of matches. Each time this takes place, the net straps have to be readjusted to pull the net to the regulation level.

The proper height of the net is an issue at all levels of the sport. Serious tennis players and your average enthusiasts generally carry measuring devices in their bag to correct the net height prior to playing. The serious player may carry a measuring tape, while the average player will sometimes use their tennis racquet to estimate where the height of the net should be.

Over the years, there have been many variations on inventions in order to make an attempt at setting and maintaining the tennis net at its correct height. Muir (U.S. Pat. No. 4,973,055) delineates a net strap with a measuring system that incorporates two pieces of net strap material that fasten to the court anchor by a snap clip with two heads. There is a buckle with a serrated edge that one of the straps is slide through, and is folded back onto itself using a hook and loop fastening method. There is a sliding measuring tape that is woven into the strap material that measures the net to the correct height. The issue with this measuring system is that it does not keep the net at the correct height indefinitely or even over a short period of time. The buckle, with its serrated edge cannot keep the fabric from slide through itself over short periods due to the pressure of the net trying to move back to its original height prior to being pulled down and attempted to be locked into place. Also, due to the applied pressure, the serrated edge on the buckle eventually tears through the fabric, and thus renders the strap inoperable. The measuring tape woven into the fabric is visually different than most other straps. It can be very distracting to even the average player, much less at a professional level. The professional tour seeks to have no distractions on the net during play. The measuring and buckle system on this strap are both visually distracting to assemble and maintain. Another negative issue with this strap is that is does not adhere the two sides of the strap through the net to each other, which keeps the wind from getting between the two straps, causing a vibration that could set off the "Let Monitor". At the professional level, they use an electronic "Let" monitoring system that is easily set off by vibration of the net. Generally, this vibration is from the ball hitting the top of the net, and then going over and into service box. However, on a windy day, this happens frequently to straps that do not adhere to itself through the net. (A "Let" is when a served tennis ball hits the net and falls over and into the correct service box). Let monitoring is of vital importance at the professional level. There are several "Let Monitoring Devices" that are used; microphones, vibrations detectors, optical monitors & human detection. Several of these may be used in combination on one net at a professional tournament. If there are false let calls during a point, it can potentially change the outcome of a point, game or possibly a match.

Pandak (U.S. Pat. No. 4,247,099) patented a net strap that incorporates a measuring system with a single strap which is fed through a snap clip and fastened with a pair of interlocking rings and or a Velcro hook and loop located close to each end. The strap is draped over the net with both ends ultimately fastening to one another. The net is the correct height when one end is touching the court surface and an indication mark is on top of the net. This system works correctly when the strap is brand new, but has a few important flaws in the design; the end of the strap that should be touching the court surface is not protected, and as it weathers, it becomes abraded and frayed, thus rendering the measuring system inaccurate and useless. There must be a finite point with which to originate the measurement. Also, neither the circular rings nor the velcro can sufficiently keep the strap from slipping under the pressure of the taute net and constant impact of tennis balls hitting the net. Pandak's strap is insufficient at maintaining the correct height of the net at a recreational or professional level. Pandak's design also does not fasten each side of the strap though the net. This flaw in the design allows his measuring point to rotate around the net, and for the possibility of false "Let" calls monitored by electronic and other previously delineated methods.

Newman (U.S. Pat. No. 4,671,509) describes a tennis net strap much like the Muir's design (U.S. Pat. No. 4,973,055), however without the measuring device. The Newman strap is a single piece of material connected with a serrated buckle on one end. As with the Muir design (U.S. Pat. No. 4,973,055), the other end of the strap is fed through the buckle, and then folded back onto itself with hook and loop fastener. Newman's straps suffers the same issues as Muir's design; the buckle and Velcro will only hold the measurement for a limited amount of time before giving to the pressure of tennis balls hitting the net, the tauteness of the net, and other factors such as players hitting the net or leaning over the net to pick up tennis balls. The serrated buckle abraded and frays the strap material, also in some cases slips easily on the slick strap material. The end of the strap deteriorates easily in constant weather. All of these factors lead to the loosening of the Newman fastening design and disintegration of the finite measuring point which renders the measuring system flawed. Due to these design flaws, an external measuring device is needed to maintain the net at the correct height. The professional circuit seeks uniformity on both sides of the net, and both the Muir and Newman straps have distracting buckles, fastening devices, and materials. The Newman strap does not fasten one side of the strap to the opposing side through the net. This lack of integration with one another allows for false "Let" calls made by electronic and previously mentioned measurement devices.

Robinson (U.S. Pat. No. 1,351,066) delineates a tennis net strap that is suitable for court surfaces other than hard courts, due to his design calling for an anchoring peg and chain to be driven into the court surface. This strap calls for the destruction of current court anchors (this would entail destruction of hard and soft courts surfaces to remove the original anchor that was installed during the construction of the court; thus, having a large repair and resurfacing job thereafter. The majority of courts in the USA are hard courts (asphalt based) and Har-Tru courts (considered clay courts in the USA). This design also has a chain that is very distracting. Once installed, the measuring system maintains the court at the correct height, but at a large cost in repair in order to utilize it on a tennis court that has already been built. The Robinson strap does not fasten one side of the strap to the opposing side through the net. This lack of integration with one another allows for false "Let" calls made by electronic and previously mentioned measurement devices.

Hardy (U.S. Pat. No. 1,534,447) delineates a strap and buckle system for holding tennis nets at the correct height, but has no built-in measuring system with which to set and maintain the correct height. This strap would need an external measuring device in order for setup and maintenance. The buckle utilized by this design does hold the correct height at the professional level of play or the recreational level for extended periods of time; thus, rendering it ineffective. The Hardy strap does not fasten one side of the strap to the opposing side through the net. This lack of integration with one another allows for false "Let" calls made by electronic and previously mentioned measurement devices.

Vaile (U.S. Pat. No. 140,997) delineates a center stay device for holding the tennis net at a regulation 36 inches from the court surface to the top of the net in the center of the tennis court. This design does not allow for the many variations in anchor depths on tennis courts all over the country. This stay works provided the court anchor depth never deviates from that which the stay was initially measured. The Vaile strap does not fasten one side of the strap to the opposing side through the net. This lack of integration with one another allows for false "Let" calls made by electronic and previously mentioned measurement devices.

Davis (U.S. Pat. No. 3,549,146) delineates a tennis net center strap very much like Robinson's design (U.S. Pat. No. 1,351,066) in that the device must be forced into the court surface, making it inappropriate for hard courts. It cannot be adapted to use on preexisting anchors on most current tennis courts. This design does not allow for the many variations in anchor depths on tennis courts all over the country. This stay works provided the court anchor depth never deviates from that which the stay was initially measured. The Vaile strap does not fasten one side of the strap to the opposing side through the net. This lack of integration with one another allows for false "Let" calls made by electronic and previously mentioned measurement devices.

Boren, et au (U.S. Pat. No. 6,868,619) delineates a tennis net strap utilizing a cam buckle fastening system that locks the two ends of one piece of webbing once the height has been set. This strap has a multi-color line design that shows how far to slide the opposing end of the strap into the cam buckle. When a red line shows in a specific place seen through the cam buckle, one would know to then fasten the buckle. After the cam buckle has been fastened, a red line would show in a specific area of the cam buckle letting you know the measurement is set. This strap incorporates a metal tabbed end that is supposed to create a finite measuring point. There is a sewn measuring line above the metal tab which should be sitting atop the net to insure the net is at the regulation height for play, after the cam buckle has been fastened. This cam design with color coding is difficult to navigate, and cumbersome to install. The cam buckle has teeth that will ultimately fray and abrade the webbing material, thus rending the measuring system useless. While the cam system is working properly, one has to be concerned that the "minimal stretching webbing" chosen for this design will loosen as it weathers, thus also rendering the measuring system useless. The metal end tab utilized on this design is made from nickel coated iron. This iron material weathers poorly and quickly rusts in outdoor elements. The iron material is very thin, and disintegrates as the rust continues to form, thus, rendering the finite measuring point useless. This strap design is too cumbersome and flawed for the professional level. The appearance is too conspicuous for professional tournament play, as they are looking for uniformity and simplicity on both sides of the court. Tournament tennis net straps are removed frequently to spray the courts down after a day of tournament play, and this strap has been rejected by tour events due to the complicated nature of the design, which takes too long to install and uninstall. This strap has an internal fastening system that answers the false "Let" calls problems encountered at the professional level. However, due to the abrading webbing material from the teeth on the cam buckle, and the rusting of the metal end tab, this fastening system would be rendered useless.

Boren, et au (U.S. Pat. No. 6,955,617) describes a tennis net center strap visibly clean on both sides of the net. This strap is comprised of one piece of "Minimally stretching" webbing material (Spun Polyester). It incorporates several internal fastening systems that work well at answering many negative issues from previous tennis net center straps. One end of the strap has a metal tab pressed on it. The other end of the strap is folded back upon itself and sewn down. There is a sewn mark on the outer side of the strap 36 inches from the metal tabbed end. There is a floating buckle that is sewn to the main webbing on the interior of the strap. With the metal tab touching the court surface, the free end of the strap is placed over the top of the net, fed through a single end swivel snap clip (the snap clip is clipped to the permanent court anchor), and pull under the net to the opposite side of the net. The free end of the strap is then pulled upward while holding the metal tab to the ground. As this is done, the net is drawn downward. Once the sewn mark is atop the net, the free end of the strap is fastened with velcro to the opposing end of webbing, setting the height correctly. With the remaining "free end" webbing, you slide the end through the interior buckle, over a floating arm, out the opposing end, pulling the webbing tightly downward and vecro it back onto itself. You then fasten both sides of the strap to each other through the net via a third interior fastening system. This design works very well, and answers many negative issues from previously patented tennis net center straps. However, there are several flaws to using this strap at both the recreational and professional level. This strap has been rejected at the recreational and professional level due to the complicated nature of the design. The multiple fastening systems are too complicated to install and maintain at the recreational level. There are insufficient instructions for the average tennis player who may install or maintain the tennis net strap. At the professional level, this strap design is too complicated and time consuming to use. Tennis net straps are removed daily during tournament play to maintain the courts, and simplicity, quick installation and removal are paramount. The metal end tab is made of thin nickel plated iron, and rusts quickly in the outdoor elements. Due to the thin material of the metal and the fact that it is made of iron, the rusting is rapid and detrimental to the end tab. Thus, the iron tab disintegrates and renders the finite measuring point useless in a matter of months or less. The metal snap clip is too thin and breaks easily under the high pressure of very taut tennis nets and professional daily abuse from serves and groundstrokes exceeding 155 mphs (there is documented evidence of this happening at the US Open and other tour events). The webbing material is made of slightly stretchable spun polyester, and weathers poorly in the outdoor elements. This stretching and degradation of the webbing material renders the measuring system useless. The thread used in stitching the strap together is too thin, and degenerates quickly. Although Boren claims this strap design works on all court anchor systems, this is incorrect. Due to the precise measuring design of this strap it is not usable on above-ground anchor systems or anchor systems with support bars below the court surface. It works perfectly on anchors that are flush with the court surface. When sliding the "free end" of the strap through the buckle and pulling down on it, one can easily pull too hard, thus creating slack in the overall strap and rendering the measuring system useless. If one does not pull down the "free end" enough, it renders that part of the fastening system useless. The interior buckle utilized with this strap is a rectangular metal piece with a floating bar that ultimately does not secure the strap material from sliding due to the force applied to it by taut tennis nets, as it is a slick surface and does not grab the strap. The interior fastening system that connects one side of the strap to the opposing side through the net functions properly to avoid false "let" calls. However, due to the thin thread used to manufacture these straps which deterioration in outdoor elements, and the complicated buckle system that can cause slack in the overall strap, even this interior fastening system can be rendered useless.

This current strap being applied for is a self-measuring tennis net center strap that is perfect for the professional and recreational level, and is currently being used at both. It is a very simplistic strap that is visually clean, and is guaranteed to maintain any tennis net at the current regulation height of 36 inches. This strap installs on any tennis court anchor (some tennis courts have anchors above the court surface and varying degrees below the court surface), on any style tennis net on any surface tennis court (there are many different court surfaces available to players; grass, asphalt, concrete, American clay, European clay, omni style, etc.). This strap does not utilize buckles or rings. There are no visible fastening mechanisms on the exterior of the strap. This is very important at the professional level, as they strive for no court distractions. This strap easily installs in under one minute and is guaranteed not to slip once fastened. It incorporates an all internal multi-fastening system that is quick and easy to navigate. It has a non-rust alloy tab, coated in a protective metal casing and extra protective coating to insure no wear to the metal or degradation of the finite measuring point. The overall design of this tennis net center strap, comprised of a specific length of non-stretch strap material, non-rust alloy finite measuring point, non-rust alloy swivel snap clip with two inch loop eye, heavy duty sewing material, label with illustrated instructions on the interior of the strap material, specific lengths of hook and loop fasteners and a secondary fastening system (both interior once installed), presents solutions to all of the flaws of past patented tennis net center straps.

This self-measuring tennis net center strap is made of a durable non-stretch material insuring no variations in the fixed measurement system. It is made with thick durable thread to withstand weathering in the outdoor elements. The one-sided swivel snap clip with 2 inch loop on the opposing end is made of non-rust alloy coated in dense nickel plating to insure no degradation due to weathering in the outdoor elements. The two sides of the strap are fastened to one another through the tennis net, integrating the strap to the net, itself. This makes the strap more stable and insures no false "let" calls at the professional level. False "let" calls are a constant issue at professional tennis tournaments due to wind vibrating ordinary tennis net straps, setting off any usable monitor system. (A "let" is called by the umpire using various detection systems when a ball hits the net and continues over the net into the opposing court within the playable court surface. "Lets" may also be called for various distractions during a point being played. False "let" calls are caused by unseen variables, such as the wind vibrating the net strap, and being detected by measuring devices).

BRIEF SUMMARY OF THE INVENTION

The basis of this invention is to provide a self-measuring, durable, non-slip-tennis net center strap that installs quickly with no external measuring devices, while maintaining the tennis net at the current regulation height above any court surface. This tennis net strap appeals to all of the needs of the professional tennis tour and recreational tennis population alike. This strap is simplistic and adaptable to any court surface. No other patented tennis net center strap can truly make this claim. To accomplish this, this strap has no buckles, externally or internally that may complicate or abrade the strap material. It is clean and unencumbered of buckles or other unsightly distractions. The strap material has special webbing designed exclusively for purpose of making it non-stretch. It utilizes a universal swivel snap clip that is adaptable to any court anchor. The snap clip has a bolt snap on one side to attach to the court anchor, while the opposing end has a two inch loop providing the strap an opening to slide through. The strap has a non-rust alloy tab with a nickel plating and additional protective coating pressed onto one of its ends, a sewn indication mark to let the installer know how high the net should be, interior heavy duty hook and loop fastening for securing the net height, and an interior secondary fastening system (preferably button and buttonhole swatches, but not limited to) to fasten the two sides of the net to each other through the net, itself. This final interior fastening system guarantees the strap will maintain the perfect net height once is has been set, and guards against false "let" calls during professional and college tournament play. This strap has extra heavy duty stitching for durability in all-weather circumstances.

This tennis net center strap, made from non-stretch material having specific materials woven into it to insure no stretching, is laid across a tennis net with the fastening system facing the net. One end of the strap has a non-rust alloy tab with nickel plating and additional protective coating pressed onto it. The tab has interior teeth that guarantee permanent integration with the strap. This tab end of the strap is on the side of the installer. The installer of the strap makes sure the sewn indication mark is also on his side of the tennis net. The other end of the strap (which is folded back onto itself and sewn down to insure no fraying) is taken from the opposite side of the tennis net and fed through the two inch loop eye of the non-rust swivel snap clip (The snap clip has a bolt snap on one end that will fasten to any court anchor, and a 2 inch eye loop at the opposing end. It is made of a non-rust strong alloy with nickel plating). The non-metal tabbed end is then draw through the snap clip loop eye, under or through the tennis net (The ATP states the net's bottom must be touching the court surface, thus the tennis net center strap would have to be fed through the net instead of under it) and pull to the installers side. With one hand holding the metal tabbed end to the court surface, the other hand of the installer will take the non-metal tabbed end of the strap and pull it upward until the net is pulled down enough for the sewn indication mark to be atop the tennis net. The installer then fastens the two ends of the strap together via the hook and loop to secure the height. With the metal tab touching the court surface, and the sewn indication mark atop the net, the net is a perfect regulation 36 inches high. The installer then fastens both sides of the net together through the net via the button & buttonhole swatches. This final step insures the strap will not rotate or disengage from the set measurement. It also guards against vibrations in high winds that sometimes cause false "let" calls in professional and collegiate tennis matches.

This tennis net strap solves all of the problems of previously patented straps. Its self-measuring system is simple, and dependable. The non-rust alloy tab plated in nickel with extra protective coating insures a precise finite measuring point that is guaranteed not to disintegrate by rusting or corroding in weather. The non-rust alloy swivel snap clip is of heavier grade metal and is guaranteed not to rust or break under the pressure of professional taut tennis nets and daily abuse from tennis balls hitting the net and net strap at speeds exceeding 155 mph. The stitching in the webbing of the strap is very thick and durable, and weathers much longer then preexisting net straps. There are no buckles or external fastening devices that are generally too difficult to navigate and maintain that will abrade or fray the webbing material. All of the fasteners are internal, making this strap perfect for professional play (professional tournaments strive for no distractions during play). The strap material will not stretch, as it is made from specific non-stretch materials, and integrates certain non-stretch materials woven into the webbing, itself. This strap has durable labels with printed directions for installation sewn onto the interior of the fabric; this insures everyone will know how to install this strap, whether professional or recreational player. The interior hook and loop fasteners are made from very heavy duty material and weather better than previous straps. The secondary interior fastening system that integrates both sides of the strap through the net is sewn onto the webbing using very thick, high grade thread and weathers better than previous net straps. This fastening system helps guard against false "let" calls during professional and collegiate tournaments. This strap is guaranteed to install on any net, on any court surface, on any style anchor (above or below court surface). Though a few straps have made this claim, they have been proven inaccurate. This tennis net strap is accepted by the USTA as a viable usable strap is currently used on all courts at the US Open Billy Jean King tennis facility in Flushing Meadows, N.Y. 2011. The design of this strap corrects all of the flaws of previously patented tennis net straps, and is more simplistic to install and maintain. It is guaranteed not to slip once correctly installed.

DETAILED DESCRIPTION OF THE INVENTION

Figure 1:
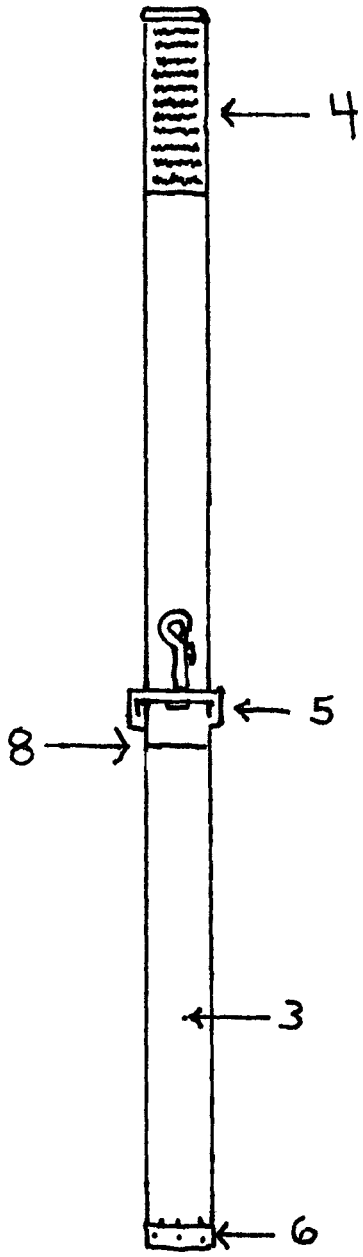
FIG. 1 is an illustration of the tennis net center strap from a flat perspective before installation. This view shows the outer side of the strap once installed. It depicts the orientation of the various components of the strap. The non-rust alloy tab with nickel plating and extra protective coating is shown at the bottom of the strap. It reveals the sewn indication mark located under the sliding non-rust swivel snap clip with 2 inch loop eye. The top of the illustration shows one half of a hook and loop swatch (a swatch of hook) sewn to the non-stretch webbing material. Note the top end of the webbing is folded over and sewn back onto itself.
Figure 2:
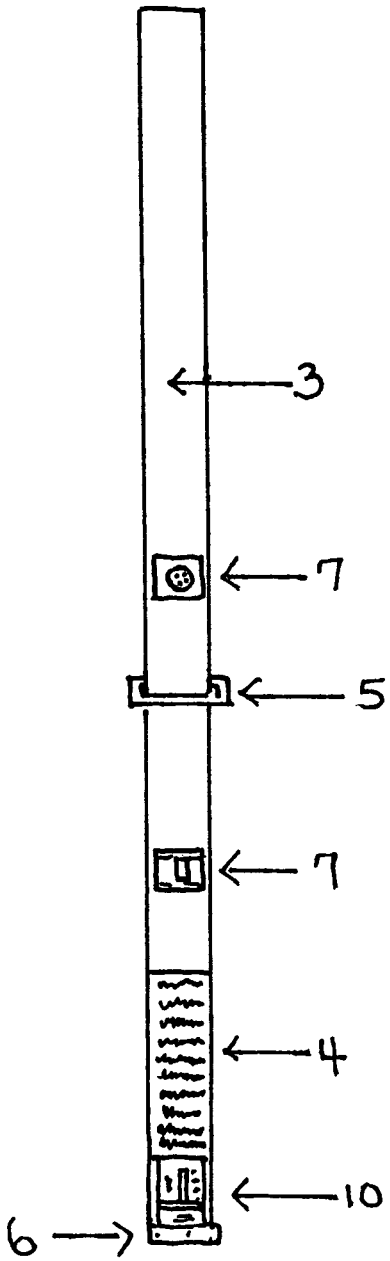
FIG. 2 is an illustration of the tennis net center strap laid flat before installation. This view shows the interior side of the strap that faces the net when installed. It depicts the non-rust alloy tab (plated in nickel with extra protective coating) permanently pressed onto the webbing. Just above the metal tab shows the detailed illustrated installation instructions for setting the strap correctly on any net, on any tennis court. Above the permanently sewn on instructions, you will find the other half of the hook and loop (a swatch of Loop) swatch show on FIG. 1 sewn onto the strap. Above the Velcro loop you will find a swatch of webbing material with a buttonhole sewn into it. The swatch is sewn onto the non-stretch webbing. Continuing up the strap, you will observe the obverse view of the non-rust alloy, nickel plated swivel snap clip (previously shown in FIG. 1). Above the snap clip, you find a swatch of webbing sewn onto the strap material. This swatch has a 1 inch white button sewn onto it.
Figure 3:
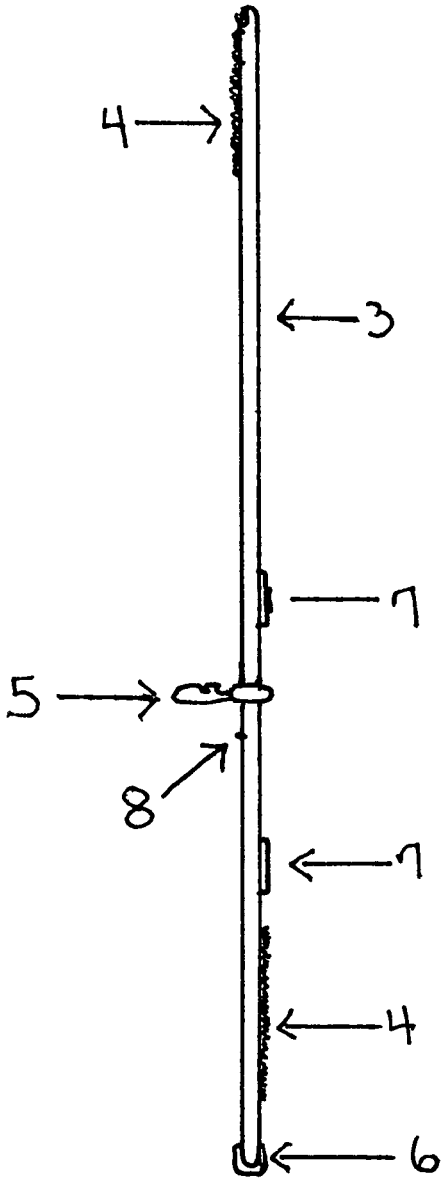
FIG. 3 shows a side view of the tennis net center strap before installation. You will observe the previously mentioned swatches of hook and loop (from FIGS. 1 & 2) at the top and bottom of the illustration, on opposing sides of the strap. You will see a side view of the buttonhole swatch, and the button swatch sewn onto the strap material. Note the side view of the floating, non-rust allow, nickel plated swivel snap clip with 2 inch loop eye. The non-rust alloy tab plated in nickel, with extra protective coating is shown permanently pressed onto the bottom of the strap material. You will observe the top end of the strap that is slightly folded back onto itself and sewn to the strap material.
Figure 4:
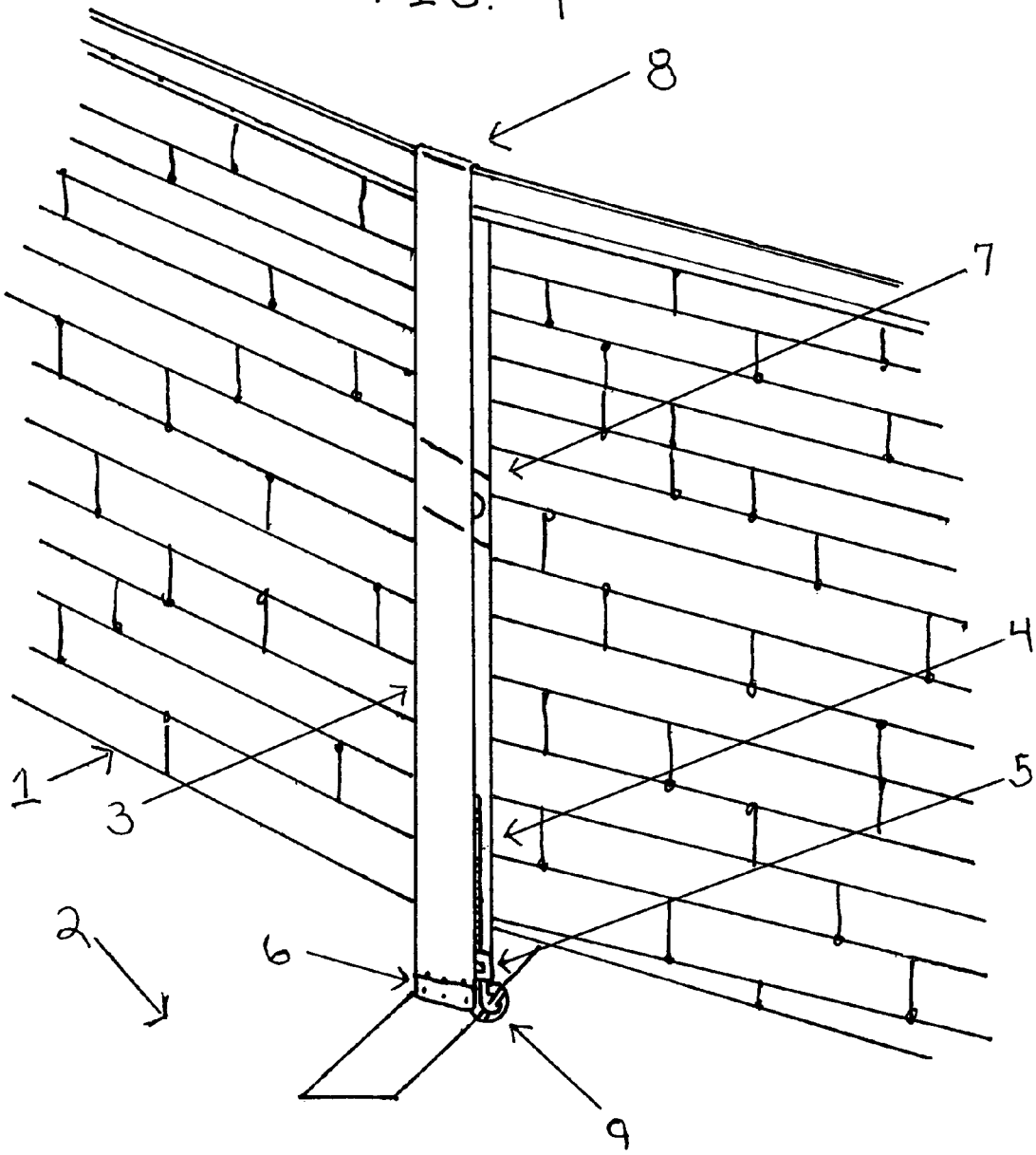
FIG. 4 depicts a perspective representation of the tennis net center strap installed onto a tennis net. You will observe the non-rust alloy tab touching the court surface, and the sewn indication mark atop the tennis net. This illustration reveals the alignment of both the button and buttonhole swatches as they will be fastened to each other upon proper installation. You will observe the end of the strap that is slightly folded back onto itself being fed through the snap clip, and fastened to the opposing end of the strap material via hook and loop. The snap clip is attached to the anchor (the anchor is a permanent part of the tennis court. It is located in the center of the court under the tennis net), shown as a hole in the court surface with a bar across it. This illustration reveals there are no visible fastening devices show from the outside of the tennis net center strap as it is installed correctly.

A tennis court (2) is divided at the center by a tennis net (1), which is suspended by a metal cable that is attached to two posts at opposing sides of the court. The tennis net strap (3) is installed at the center of the tennis net, pulling the taut net down to the regulation height of 36 inches. To accomplish this, the tennis net center strap (3) is constructed from a non-stretch material, and utilizes a snap clip (5) with a bolt snap on one end and a 2 inch loop eye on the other and a non-rust alloy tab (6), permanently attached to one end of the strap (3) for a finite measuring point. Hook and loop (4) fasteners are utilized for connecting both ends of the strap (3) once the exact height has been attained. A secondary internal button and buttonhole fastening system (7) is utilized to connect both sides of the strap (3) to each other through the net (1), to insure no slipping or variance in the net height, and no false "let" calls during play. There is a sewn indication mark (8) on the outer side of the strap (3) which tells the installer the net (1) is a perfect 36 inches once the strap (3) is installed correctly. This tennis net strap (3) is very simplistic and works perfectly on any tennis net (1), and any tennis court anchor (9), regardless of variations. It utilizes no buckles that fray and abrade the strap (3) material, causing the measuring system to fail. And, all the fastening systems are interior for no distractions to accommodate the professional tour events.

The tennis net center strap (3), being constructed of a non-stretch material is laid across the tennis net (1) at the center of the net (1) with the non-rust alloy nickel plated tab (6) (with extra protective coating) on the side of the installer. The installer reaches under the tennis net (1) and clips the non-rust alloy, nickel plated swivel snap clip (5) to the bar of the permanent anchor (9). The anchor (9) is permanently set into the court surface (2). The installer then reaches under the net (1) to obtain the opposing end of the tennis net center strap (3). This end of the strap (3), which has been folded back onto itself and sewn to itself to prevent fraying or disintegration, is fed through the "loop eye" of the snap clip (5) (the snap clip (5) has a bold snap on one end and a 2 inch loop eye on the other end), and pulled under the net towards the installer. The installer holds the non-rust alloy tabbed end (6) to the court surface (2) with one hand, and with the other hand, pulls the opposing end of the strap (3) upward until the net is drawn down towards the court surface (2), and the sewn indication mark (8) is atop the tennis net (1). Both ends of the strap (3) are then locked together using the hook and loop fasteners (4) to set the correct net height. The installer then locates the two interior button and buttonhole swatches (7), sewn to the strap (3), that are facing the tennis net (1), and fastens them together through the net (1), itself. This last internal fastening system (7) prevents the set net height from ever slipping, and insures no false "let" calls during play.

Let it be noted that the strap (3) material is preferably 2 inches wide, but can vary in width slightly, and is preferably shades of white or natural coloring. The strap (3) should be sized to slide easily through the snap clip (5). The strap (3) material may vary as long as it remains non-stretch and does not affect the function of the design. The end tab (6) is always a non-rust alloy, but may be plated with variations of metal and or coated in variable colors, but preferably white to match the preferable strap (3) color for uniformity. The hook and loop swatches (7) are sewn onto the strap (3) material, but may be attached in any other secure fashion. The hook and loop (4) is the wide of the strap (3) or more narrow. The length of the hook and loop (4) swatches may vary slightly, but never enough to impede the proper function of the design. The strap (3) material may vary slightly in length, but never enough to impede the proper function of the design. The snap clip (5) may vary in design and size, but never enough to impede the function of the design. The sewn indication mark (8) is made from a durable thread, but may vary in material as long as it does not impede the function of the design. The sewn indication mark (8) will always measure the net height to the perfect regulation height from the non-rust alloy end tab (6). The sewing material on the strap (3) may vary as long as it does not impede the function of the design. The secondary fastening system (7) is preferably button and buttonhole (7), but may vary slightly as long as it does not impede the function of the design. A label (10) with illustrated instruction is sewn onto the interior of the strap (3) near the metal tabbed end (6).

I claim:

1. A tennis net center strap with a discrete measuring system that secures any tennis net to regulation height above the surface of the tennis court using no external fastening system, said center strap consists of:

- a single piece of non-stretch strap woven with materials to insure consistency and durability;
- a non-rust nickel-plated or other protective coating tab permanently pressed onto one end of the strap;
- two pieces of hook-and-loop fasteners sewn to specific areas of the strap;
- a non-rust nickel-plated swivel snap clip with a two inch eye loop;
- one swatch of material with a buttonhole and a second swatch of material of equal size with a two inch button sewn on it, both of which are sewn at specific areas on the strap;
- a discrete indication mark sewn at a specific area on the strap; and,
- a label with illustrated installation instructions sewn onto the strap;
- wherein the strap is adapted to be draped across any tennis net, with all of the fasteners facing towards the net;
- wherein said non-rust nickel-plated snap clip fastens to any court surface anchor system by snapping the bolt clip to the anchor bar with the end of the strap that has the non-rust nickel-plated tab pressed onto it on the installer's side of the net;

wherein the opposing end of the strap is hanging on the opposite side of the net and fed through the snap clip's two inch eye loop and pulled under or through the net to the installer's side;

wherein the tabbed end of the strap is held directly to the court surface with one hand and pulled upward on the opposite end of the strap such that the net can be lowered until the discrete sewn indication mark sits even with the top of the tennis net;

wherein once the said sewn indication mark is atop the net, the correct height has been attained and the installer is able to press the two sides of the strap together, adjoining the two swatches of hook-and-loop fasteners, thus fastening both ends of the strap together, locking the correct height;

wherein once the height has been secured, the installer is able to fasten the aligned button and buttonhole swatches together through the net, thus insuring the net will maintain the correct height indefinitely, disallowing any rotation of the strap around the tennis net and protecting against potential false "let" calls indicated by electronic or other monitoring systems.

* * * * *